US008125394B2

(12) United States Patent
Chiang

(10) Patent No.: US 8,125,394 B2
(45) Date of Patent: Feb. 28, 2012

(54) ELECTRONIC DEVICE ANTENNA WITH QUARTERED RECTANGULAR CAVITY

(75) Inventor: Bing Chiang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 583 days.

(21) Appl. No.: 12/356,496

(22) Filed: Jan. 20, 2009

(65) Prior Publication Data

US 2010/0182205 A1 Jul. 22, 2010

(51) Int. Cl.
*H01Q 1/24* (2006.01)
*H01Q 1/42* (2006.01)

(52) U.S. Cl. ..... 343/702; 343/789

(58) Field of Classification Search ..... 343/702, 343/789, 872

See application file for complete search history.

(56) References Cited

U.S. PATENT DOCUMENTS 4,733,245 A 3/1988 Mussler (Continued)

FOREIGN PATENT DOCUMENTS

JP 2007189385 * 7/2007

OTHER PUBLICATIONS

Ayala Vazquez et al., U.S. Appl. No. 12/553,944, filed Sep. 3, 2009.

(Continued)

*Primary Examiner* — Hoang V Nguyen

(74) *Attorney, Agent, or Firm* — Treyz Law Group; G. Victor Treyz; David C. Kellogg

(57) ABSTRACT

Antennas for electronic devices such as portable computers are provided. An antenna may be formed from a conductive cavity and an antenna probe that serves as an antenna feed. The conductive cavity may have the shape of a quartered rectangular cavity and may have first and second side walls, top and bottom walls, and first and second openings. The first and second openings may be planar in shape and may meet at a right angle along an axis. The antenna probe may be disposed along the axis. The axis at which the first and second openings of the cavity meet may be located at the corner of an electronic device housing. The portable computer may have upper and lower housing portions that meet at a gasket. The gasket may be placed adjacent to the cavity face openings so that radio-frequency signals may enter and exit the cavity through the gasket.

18 Claims, 11 Drawing Sheets

U.S. PATENT DOCUMENTS

| | | | | |
|---|---|---|---|---|
| 6,081,729 | A | 6/2000 | Bauerschmidt et al. | |
| 6,225,959 | B1 | 5/2001 | Gordon | |
| 6,339,400 | B1 | 1/2002 | Flint et al. | |
| 6,380,930 | B1 | 4/2002 | Van Ruymbeke | |
| 6,680,712 | B2 * | 1/2004 | Ogawa et al. | 343/789 |
| 6,894,650 | B2 | 5/2005 | Darden et al. | |
| 2009/0153412 | A1 | 6/2009 | Chiang et al. | |
| 2010/0073241 | A1 * | 3/2010 | Ayala Vazquez et al. | 343/702 |

OTHER PUBLICATIONS

Bevelacqua et al., U.S. Appl. No. 12/750,661, filed Mar. 30, 2010.
Shiu et al., U.S. Appl. No. 12/750,660, filed Mar. 30, 2010.
Chiang et al., U.S. Appl. No. 12/500,570, filed Jul. 9, 2009.
Guterman et al., U.S. Appl. No. 12/553,943, filed Sep. 3, 2009.
Chiang et al., U.S. Appl. No. 12/401,599, filed Mar. 10, 2009.
Ayala Vazquez et al., U.S. Appl. No. 12/486,496, filed Jun. 17, 2009.
Chiang et al., U.S. Appl. No. 12/104,359, filed Apr. 16, 2008.

* cited by examiner

ELECTRONIC DEVICE ANTENNA WITH QUARTERED RECTANGULAR CAVITY

BACKGROUND

This invention relates to electronic devices and, more particularly, to antennas for electronic devices.

Portable computers and other electronic devices often use wireless communications circuitry. For example, wireless communications circuitry may be used to communicate with local area networks and remote base stations.

Wireless computer communications systems use antennas. It can be difficult to design antennas that perform satisfactorily in electronic devices such as portable computers. It is generally desirable to create efficient antennas. For example, efficient antennas are desirable for portable computers, because efficient antennas help conserve battery power during wireless operations. However, optimum antenna efficiency can be difficult to obtain, because portable computer designs restrict the possible locations for implementing the antennas and require that the antennas be constructed as small light-weight structures. For example, it can be difficult to implement efficient antennas in portable computers that contain conductive housing structures, because the conductive housing structures can block radio-frequency signals and thereby reduce the effectiveness of the antennas.

It would therefore be desirable to be able to provide improved antenna arrangements for electronic devices such as portable computers.

SUMMARY

An antenna for an electronic device such as a portable computer is provided. The antenna may use a cavity-backed configuration in which conductive cavity walls are placed in the vicinity of an antenna feed structure. The cavity walls may form a cavity structure that resembles a quartered rectangular cavity. The quartered cavity may be mounted within an electronic device. For example, the quartered cavity may be mounted in the corner of a portable computer housing or other electronic device housing.

Further features of the invention, its nature and various advantages will be more apparent from the accompanying drawings and the following detailed description of the preferred embodiments.

DETAILED DESCRIPTION

The present invention relates to antenna structures for electronic devices. The antennas may be used to convey wireless signals for suitable communications links. For example, an electronic device antenna may be used to handle communications for a short-range link such as an IEEE 802.11 link (sometimes referred to as WiFi®) or a Bluetooth® link. An electronic device antenna may also handle communications for long-range links such as cellular telephone voice and data links.

Antennas such as these may be used in various electronic devices. For example, an antenna may be used in an electronic device such as a handheld computer, a miniature or wearable device, a portable computer, a desktop computer, a router, an access point, a backup storage device with wireless communications capabilities, a mobile telephone, a music player, a remote control, a global positioning system device, devices that combine the functions of one or more of these devices and other suitable devices, or any other electronic device. With one suitable arrangement, which is sometimes described herein as an example, the electronic devices in which the antennas are provided may be portable computers such as laptop (notebook) computers. This is, however, merely illustrative. Antennas may, in general, be provided in any suitable electronic device.

Figure 1:
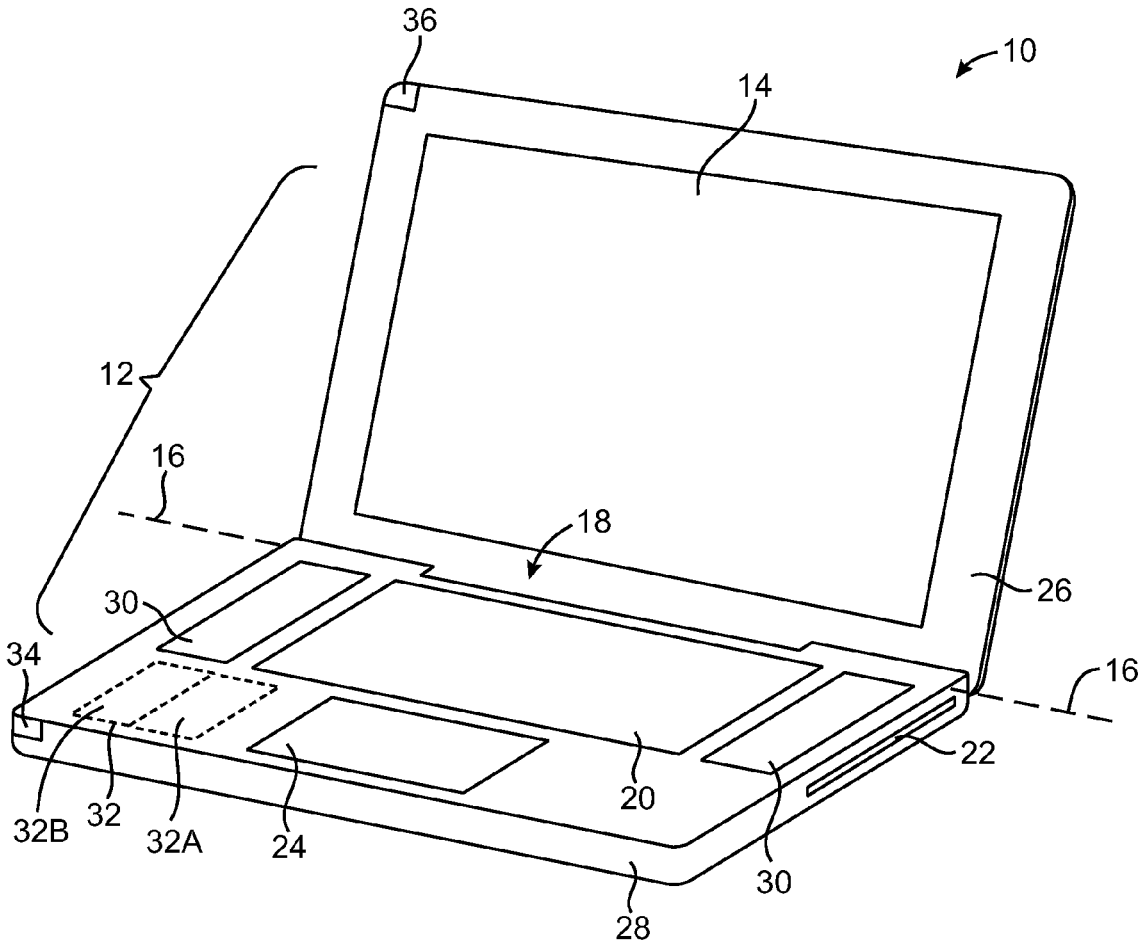
FIG. 1 is a perspective view of an illustrative electronic device such as a portable computer in which an antenna may be implemented in accordance with an embodiment of the present invention.

An illustrative electronic device such as a portable computer in which an antenna may be provided is shown in FIG. 1. As shown in FIG. 1, portable computer 10 may have a housing 12. Housing 12, which is sometimes referred to as a case, may be formed from one or more individual structures. For example, housing 12 may have a main structural support member that is formed from a solid block of machined aluminum or other suitable metal. Multipart housings may be used in which two or more individual housing structures are combined to form housing 12. The structures in housing 12 may include internal frame members, external coverings such as sheets of metal, etc. Housing 12 and its associated components may, in general, be formed from any suitable materials such as such as plastic, ceramics, metal, glass, etc. An advantage of forming housing 12 at least partly from metal is that metal is durable and attractive in appearance. Metals such as aluminum may be anodized to form an insulating oxide coating.

Case 12 may have an upper portion 26 and a lower portion 28. Lower portion 28 may be referred to as the base unit housing or main unit of computer 10 and may contain components such as a hard disk drive, battery, and main logic board. Upper portion 26, which is sometimes referred to as a cover or lid, may rotate relative to lower portion 28 about rotational axis 16. Portion 18 of computer 10 may contain a hinge and associated clutch structures and may sometimes be referred to as a clutch barrel.

Lower housing portion 28 may have an opening such as slot 22 through which optical disks may be loaded into an optical disk drive. Lower housing portion 28 may also have touchpad 24, keys 20, and other input-output components. Touch pad 24 may include a touch sensitive surface that allows a user of computer 10 to control computer 10 using touch-based commands (gestures). A portion of touchpad 24 may be depressed by the user when the user desires to "click" on a displayed item on screen 14. If desired, additional components may be mounted to upper and lower housing portions 26 and 28. For example, upper and lower housing portions 26 and 28 may have ports to which cables can be connected (e.g., universal serial bus ports, an Ethernet port, a Firewire port, audio jacks, card slots, etc.). Buttons and other controls may also be mounted to housing 12.

If desired, upper and lower housing portions 26 and 28 may have transparent windows through which light may be emitted from light-emitting diodes. Openings such as perforated speaker openings 30 may also be formed in the surface of housing 12 to allow sound to pass through the walls of the housing.

A display such as display 14 may be mounted within upper housing portion 26. Display 14 may be, for example, a liquid crystal display (LCD), organic light emitting diode (OLED) display, or plasma display (as examples). A glass panel may be mounted in front of display 14. The glass panel may help add structural integrity to computer 10. For example, the glass panel may make upper housing portion 26 more rigid and may protect display 14 from damage due to contact with keys or other structures.

Portable computer 10 may contain circuitry 32. Circuitry 32 may include storage and processing circuitry 32A and input-output circuitry 32B.

Storage and processing circuitry 32A may include one or more different types of storage such as hard disk drive storage, nonvolatile memory (e.g., flash memory or other electrically-programmable-read-only memory), volatile memory (e.g., static or dynamic random-access-memory), etc. Storage and processing circuitry 32A may be used in controlling the operation of computer 10. Processing circuitry in circuitry 32A may be based on processors such as microprocessors, microcontrollers, digital signal processors, dedicated processing circuits, power management circuits, audio and video chips, and other suitable integrated circuits. Storage and processing circuitry 32A may be used to run software on computer 10, such as operating system software, application software, software for implementing control algorithms, communications protocol software etc.

Input-output circuitry 32B may be used to allow data to be supplied to computer 10 and to allow data to be provided from computer 10 to external devices. Examples of input-output devices that may be used in computer 10 include display screens such as touch screens (e.g., liquid crystal displays or organic light-emitting diode displays), buttons, joysticks, click wheels, scrolling wheels, touch pads, key pads, keyboards, microphones, speakers and other devices for creating sound, cameras, sensors, etc. A user can control the operation of computer 10 by supplying commands through these devices or other suitable input-output circuitry 32B. Input-output circuitry 32B may also be used to convey visual or sonic information to the user of computer 10. Input-output circuitry 32B may include connectors for forming data ports (e.g., for attaching external equipment such as accessories, etc.).

Computer 10 may include one or more antennas. For example, computer 10 may include one or more cavity antennas that are located at the corners of housing 12 such as corner 36 and/or corner 34 (as examples). Computer 10 may also include one or more additional antennas. The antennas in computer 10 may be coupled to wireless communications circuitry (e.g., radio-frequency transceiver circuits) in input-output circuitry 32B using coaxial cables, microstrip transmission lines, or other suitable transmission lines.

The antenna structures in computer 10 may be used to handle any suitable communications bands of interest. For example, antennas and wireless communications circuitry in circuitry 32B of computer 10 may be used to handle cellular telephone communications in one or more frequency bands and data communications in one or more communications bands. Typical data communications bands that may be handled by the wireless communications circuitry in computer 10 include the 2.4 GHz band that is sometimes used for Wi-Fi® (IEEE 802.11) and Bluetooth® communications, the 5 GHz band that is sometimes used for Wi-Fi communications, the 1575 MHz Global Positioning System band, and 2G and 3G cellular telephone bands. These bands may be covered using single-band and multiband antennas. For example, cellular telephone communications can be handled using a multiband cellular telephone antenna. A single band antenna may be provided to handle Bluetooth® communications. Computer 10 may, as an example, include a multiband antenna that handles local area network data communications at 2.4 GHz and 5 GHz (e.g., for IEEE 802.11 communications), a single band antenna that handles 2.4 GHz IEEE 802.11 communications and/or 2.4 GHz Bluetooth® communications, or a single band or multiband antenna that handles other communications frequencies of interest. These are merely examples. Any suitable antenna structures may be used by computer 10 or other electronic device to cover communications bands of interest.

The antennas in computer 10 may be implemented using any suitable antenna configuration. For example, an antenna for computer 10 may be implemented as a cavity antenna, a monopole antenna, a dipole antenna, a patch antenna, an inverted-F antenna, an L-shaped antenna, a planar inverted-F antenna (PIFA), a slot antenna, a helical antenna, a hybrid antenna including two or more of these antenna structures, or any other suitable antenna structures.

With one suitable arrangement, which is described herein as an example, at least one of the antennas used in computer 10 is implemented using a cavity antenna arrangement. With this type of configuration, a conductive cavity is formed from conductive materials such as metal. The cavity may have top and bottom surfaces (sometimes referred to as walls) and sidewalls. Unlike a completely enclosed conductive cavity, which is unable to radiate and serve as an antenna, the antenna cavity for computer 10 may use cavities from which some of the sidewall structures have been removed to form openings. The openings in the cavity antenna may be filled with a gaseous dielectric such as air or a non-gaseous dielectric. An example of a non-gaseous dielectric is a solid such as plastic or epoxy. If desired, materials such as flexible printed circuit board materials (e.g., polyimide) and rigid printed circuit board materials (e.g., fiberglass-filled epoxy) may be used in the cavity antenna.

An advantage of filling a cavity antenna with a solid dielectric material is that this may help prevent intrusion of dust, liquids, or other foreign matter into portions of the antenna. Dielectric in the cavity antenna may also be used as a support structure (e.g., when supporting a flex circuit antenna element or a portion of a housing). Dielectric materials are transparent to radio-frequency signals, so dielectric materials may be used in portions of the cavity antenna where it is desired not to block radio-frequency signals.

In general, any suitable dielectric material can be used to form dielectric cavity antenna structures for computer 10. Dielectric structures that surround or are located within the cavity of a cavity antenna may be formed from a completely solid dielectric, a porous dielectric, a foam dielectric, a gelatinous dielectric (e.g., a coagulated or viscous liquid), a dielectric with grooves or pores, a dielectric having a honeycombed or lattice structure, a dielectric having spherical voids or other voids, a combination of such non-gaseous dielectrics, etc. Hollow features in solid dielectrics may be filled with air or other gases or lower dielectric constant materials. Examples of dielectric materials that may be used in a cavity antenna and that contain voids include epoxy with gas bubbles, epoxy with hollow or low-dielectric-constant microspheres or other void-forming structures, polyimide with gas bubbles or microspheres, etc. Porous dielectric materials used in a cavity antenna in computer 10 can be formed with a closed cell structure (e.g., with isolated voids) or with an open cell structure (e.g., a fibrous structure with interconnected voids). Foams such as foaming glues (e.g., polyurethane adhesive), pieces of expanded polystyrene foam, extruded polystyrene foam, foam rubber, or other manufactured foams can also be used in a cavity antenna in computer 10. If desired, the dielectric antenna materials can include layers or mixtures of different substances such as mixtures including small bodies of lower density material.

The conductive antenna elements that form the sidewalls and other portions of a cavity antenna may be formed from conductive portions of housing 12, conductive sheets such as planar metal sheets, wires, traces on rigid printed circuit boards or flex circuit substrates, stamped metal foil patterns, milled or cast metal parts, or any other suitable conductive structures.

The operation of a quarter-cavity antenna may be understood with reference to FIGS. 2, 3, 4, and 5.

Figure 2A:
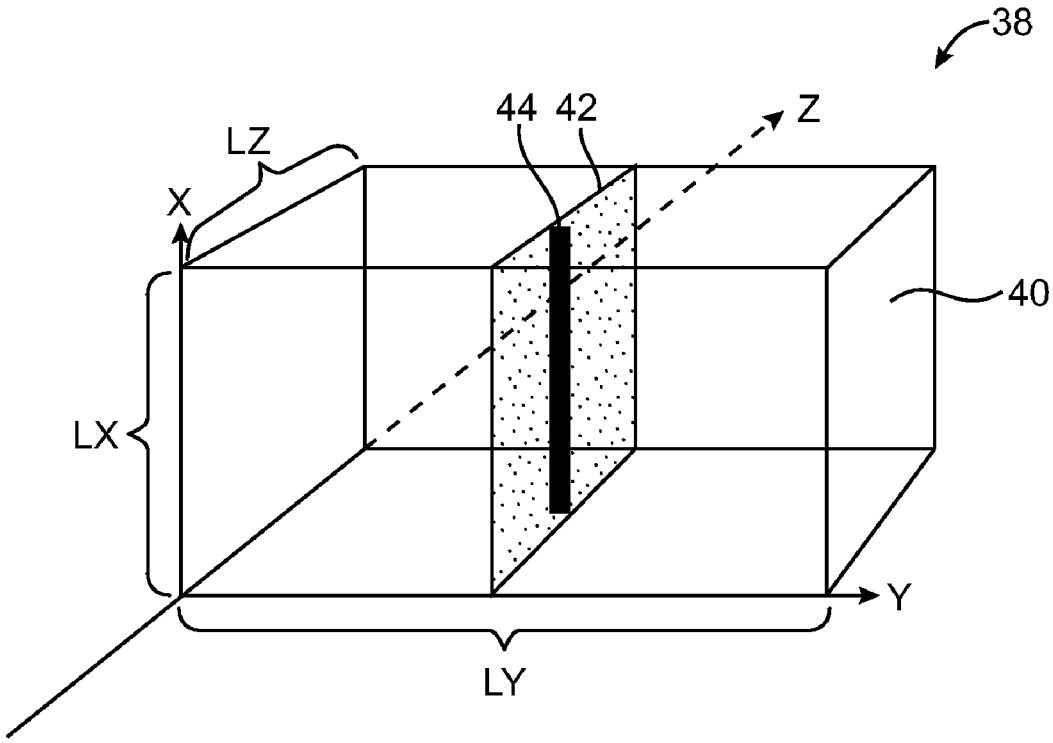
FIG. 2A is a diagram of a three-dimensional conductive cavity bisected by a vertical plane.

FIG. 2A is a diagram of a rectangular cavity with six conductive walls. Cavity 38 of FIG. 2A has dimensions of LX, LY, and LZ. Vertical plane 42 bisects rectangular cavity 38, but does not correspond to any conductive structures.

Figure 2B:
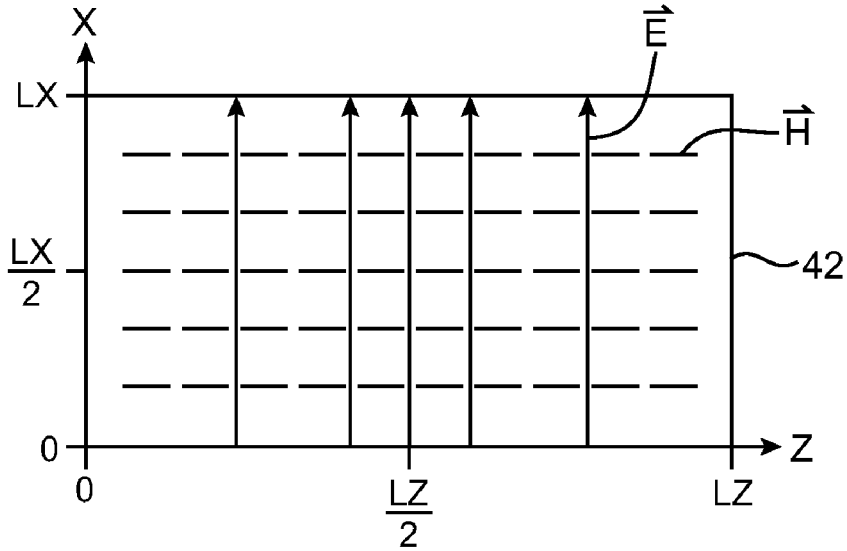
FIG. 2B is a diagram showing how electric and magnetic fields may be distributed on the vertical bisecting plane in the cavity of FIG. 2A.

Solid line 44 of FIG. 2A illustrates the location of an excitation source for cavity 38 (i.e., a probe that launches electromagnetic fields into cavity 38). Because each of walls 40 in cavity 38 is conductive, cavity 38 and probe 44 cannot function as an antenna. Nevertheless, electromagnetic radiation from probe 44 may fill cavity 38. Because of the conductive nature of walls 40, walls 40 impose boundary conditions for electromagnetic fields in cavity 38. FIG. 2B, which corresponds to vertical plane 42 of FIG. 2A, shows how electric field vectors E are oriented parallel to the X-axis and magnetic field vectors H are oriented perpendicularly, parallel to the Z-axis (for the $TE_{011}$ mode). The electric field strength is greatest around the center of the cavity (Z=LZ/2) and is essentially zero at the cavity walls (i.e., E=0 at Z=0 and at Z=LZ).

Figure 2C:
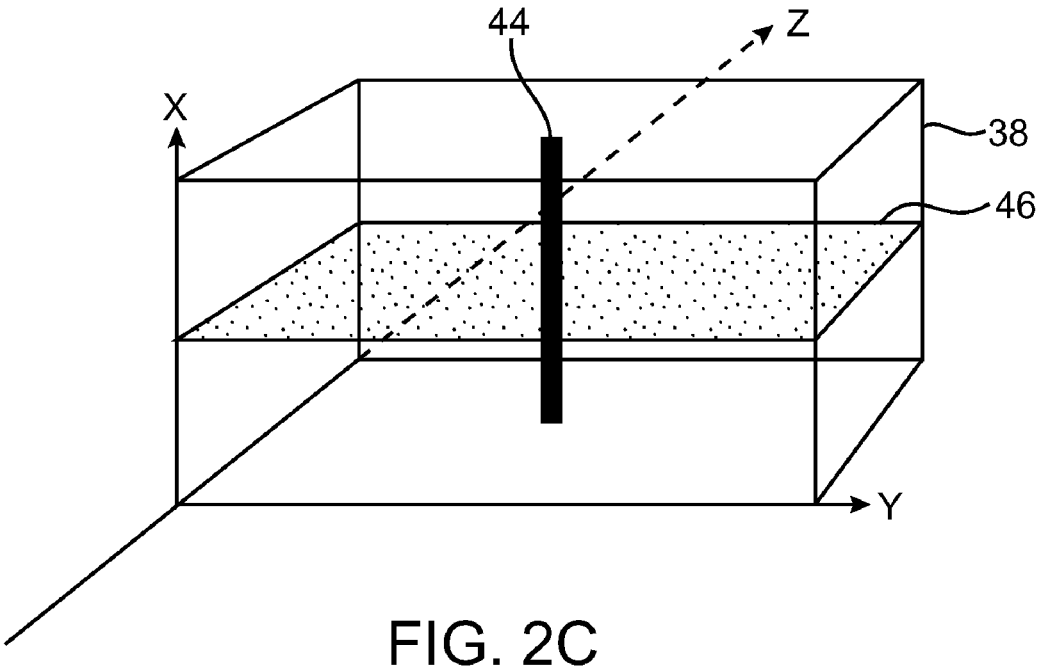
FIG. 2C is a diagram of the three-dimensional conductive cavity of FIG. 2A bisected by a horizontal plane.
Figure 2D:
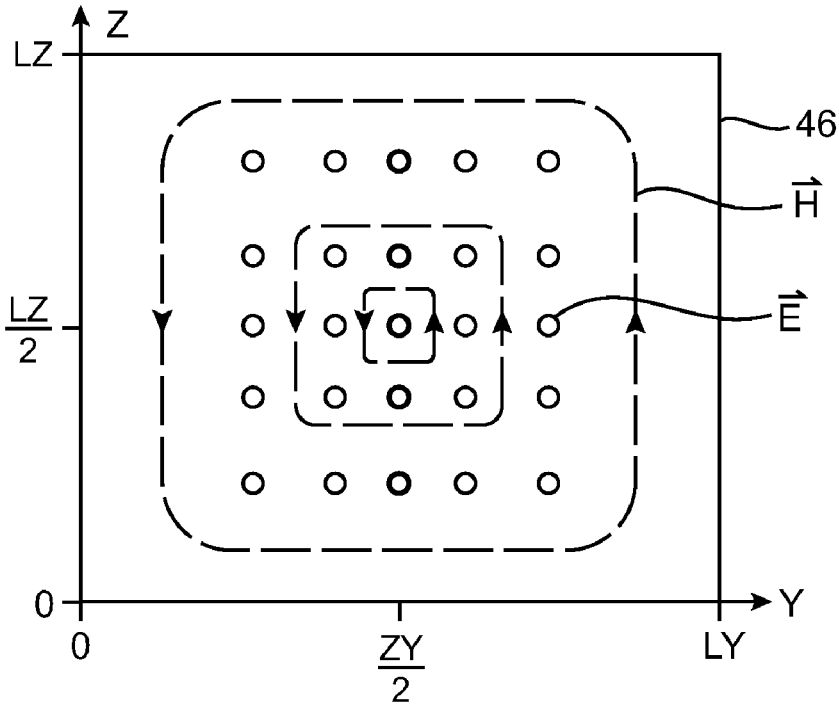
FIG. 2D is a diagram showing how electric and magnetic fields may be distributed on the horizontal bisecting plane of the cavity of FIG. 2A.

Another cross-sectional view of cavity 38 may be taken along horizontal bisecting plane 46 of FIG. 2C. The electric and magnetic fields associated with plane 46 are shown in FIG. 2D.

Figure 3A:
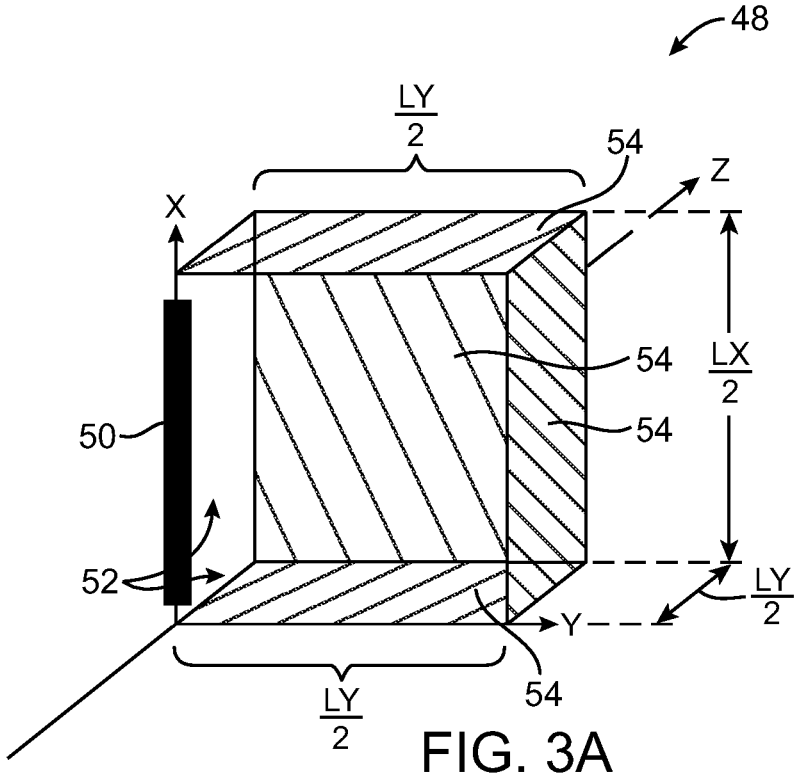
FIG. 3A is a diagram of a quartered rectangular conductive cavity of the type that may be used in forming a cavity-backed antenna in accordance with an embodiment of the present invention.

When divided into quarters, a non-radiating cavity such as cavity 38 of FIGS. 2A and 2C may be converted into a radiating cavity structure of the type that may be used in forming a cavity antenna for computer 10. An illustrative cavity antenna that has been formed from a quartered rectangular cavity in this way is shown in FIG. 3A. As shown in FIG. 3A, cavity antenna 48 may be fed by a probe structure 50 (sometimes referred to as an antenna feed or feed structure). In the FIG. 3A configuration, probe 50 is aligned with the front left corner of cavity antenna 48 and runs along the X axis. The top surface 54, bottom surface 54, right sidewall 54, and rear sidewall 54 of cavity antenna 48 are conductive. Because cavity 48 of FIG. 3A is formed from a quarter of cavity 38 of FIG. 2A and FIG. 2C, the left and front sidewalls of cavity 48 are open and form openings 52 (e.g., open planar faces filled with air or another dielectric). Planar openings 52 meet at a right angle along the X-axis.

Figure 3B:
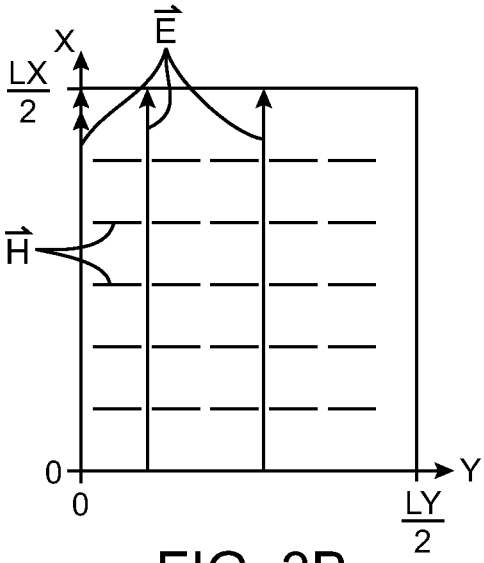
FIG. 3B is a diagram of the X-Y plane associated with the quartered cavity of FIG. 3A showing how electric and magnetic fields may be distributed over the front vertical opening in the cavity antenna structure of FIG. 3A in accordance with an embodiment of the present invention.
Figure 3C:
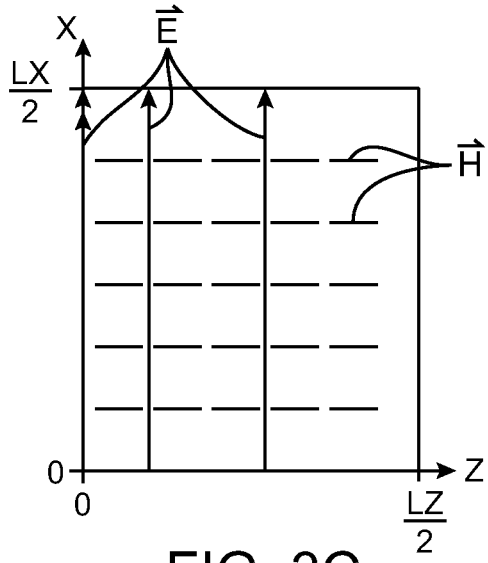
FIG. 3C is a diagram of the X-Z plane associated with the quartered cavity of FIG. 3A showing how electric and magnetic fields may be distributed over the left vertical opening in the cavity antenna structure of FIG. 3A in accordance with an embodiment of the present invention.

The dimensions of cavity antenna 48 are LX/2, LY/2, and LZ/2 (i.e., half of the dimensions of cavity 48 of FIGS. 2A and 2C). FIGS. 3B and 3C show how the electric field vectors and magnetic field vectors in cavity 48 are oriented within the X-Y plane at Z=0 and within the X-Z plane at Y=0, respectively (for the $TE_{011}$ mode). The magnitude of the electric field is greatest near where Y=0 (FIG. 3B) and near where Z=0 (FIG. 3C) and is lowest at Y=LY/2 and at Z=LZ/2.

The dimensions LZ/2 and LY/2 preferably correspond to approximately a quarter of a wavelength at the operating frequency of interest (i.e., LZ/2 and LY/2 may each be equal to $\lambda g/4$, where $\lambda g$ corresponds to the wavelength of the radio-frequency antenna signals within antenna cavity 48). It is not necessary for vertical cavity dimension LX/2 to be as large as lateral cavity dimensions LZ/2 and LY/2, because the electric field E is oriented perpendicular to the Z-Y plane.

Figure 4A:
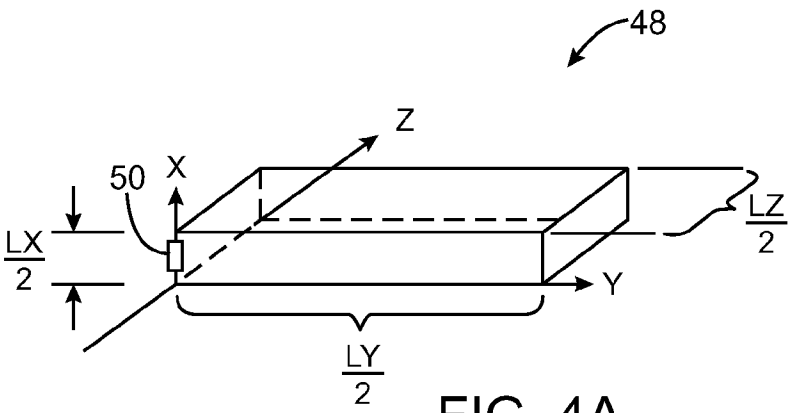
FIG. 4A is a perspective view of a quartered cavity of the type shown in FIG. 3A with a reduced height that narrows the cavity openings in accordance with an embodiment of the present invention.
Figure 4C:
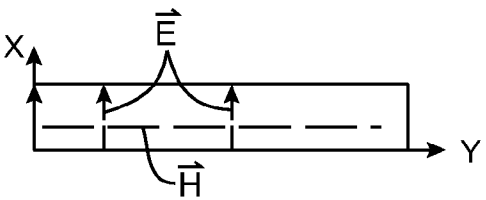
FIG. 4C is a diagram of the X-Y plane associated with the shortened quartered cavity of FIG. 4A showing how electric and magnetic fields may be distributed at the front face opening in the cavity antenna structure of FIG. 4A in accordance with an embodiment of the present invention.
Figure 4D:
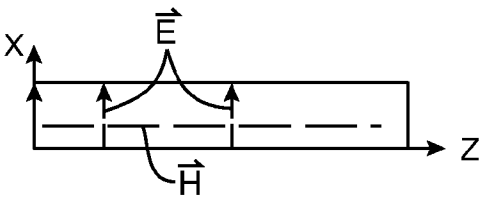
FIG. 4D is a diagram of the X-Z plane associated with the shortened quartered cavity of FIG. 4A showing how electric and magnetic fields may be distributed at the left face opening in the cavity antenna structure of FIG. 4A in accordance with an embodiment of the present invention.
Figure 4B:
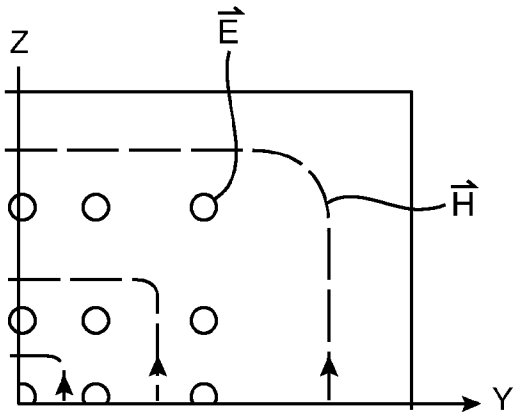
FIG. 4B is a diagram of the Y-Z plane associated with the shortened quartered cavity of FIG. 4A showing how electric and magnetic fields may be distributed at the upper and lower conductive cavity faces in the cavity antenna structure of FIG. 4A in accordance with an embodiment of the present invention.

This is illustrated in FIGS. 4A, 4B, 4C, and 4D. FIG. 4A shows how dimension LX/2 may be reduced to a size that is significantly smaller than lateral dimension LY/2 and lateral dimension LZ/2 (e.g., less than this lateral dimension, less than half of this lateral dimension, less than a quarter of this lateral dimension, less than a tenth of this lateral dimension, etc.). At an operating frequency of about 2.4 GHz, LZ/2 and LY/2 may, as an example, be about 20-40 mm, whereas cavity height LX/2 may, as an example, be several millimeters (e.g., 1-5 mm or 2-20 mm, etc.).

The ability to configure the dimensions of the cavity for cavity antenna 48 so that cavity antenna 48 is relatively short and wide, allows cavity antenna 48 to be mounted within housings that are relatively thin. For example, a relatively thin cavity antenna such as cavity antenna 48 of FIG. 4A may be mounted at a corner of housing 12 such as corner 34 or corner 36 of FIG. 1. In the vicinity of housing corners such as corners 34 and 36, it may be desirable for housing 12 to be relatively thin. The use of thin cavity antennas in housing 12 may allow the corners of housing 12 to be reduced in thickness.

Figure 5:
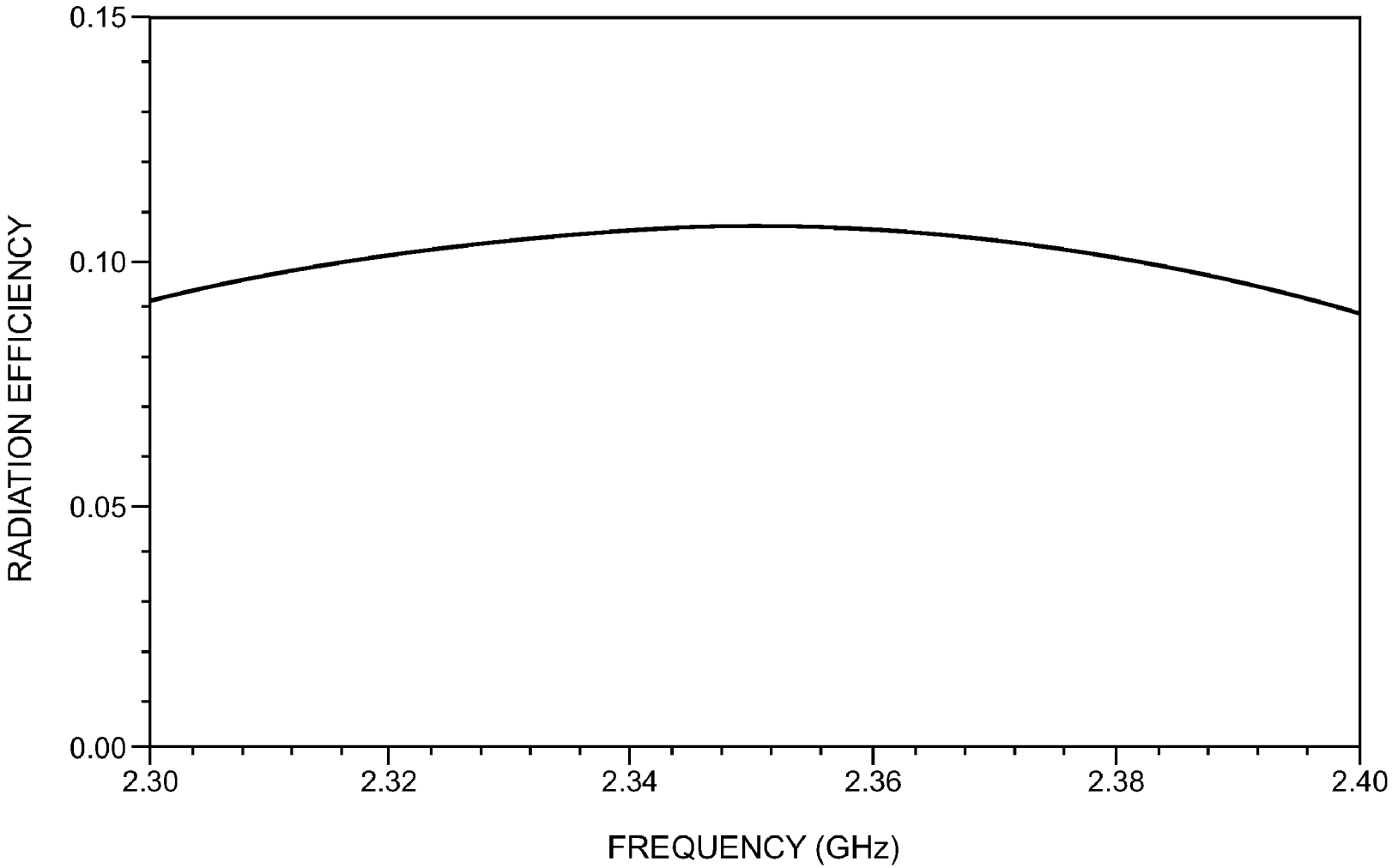
FIG. 5 is a graph of the calculated radiation efficiency of an antenna of the type shown in FIG. 4A as a function of operating frequency in accordance with an embodiment of the present invention.

A graph showing the radiation efficiency of a cavity antenna (e.g., a cavity antenna such as cavity antenna 48 of FIG. 4A) as a function of operating frequency is shown in FIG. 5. In the FIG. 5 example, cavity antenna 48 has been configured for operation in the 2.4 GHz communications band and achieves a maximum efficiency of about 10%.

Figure 6:
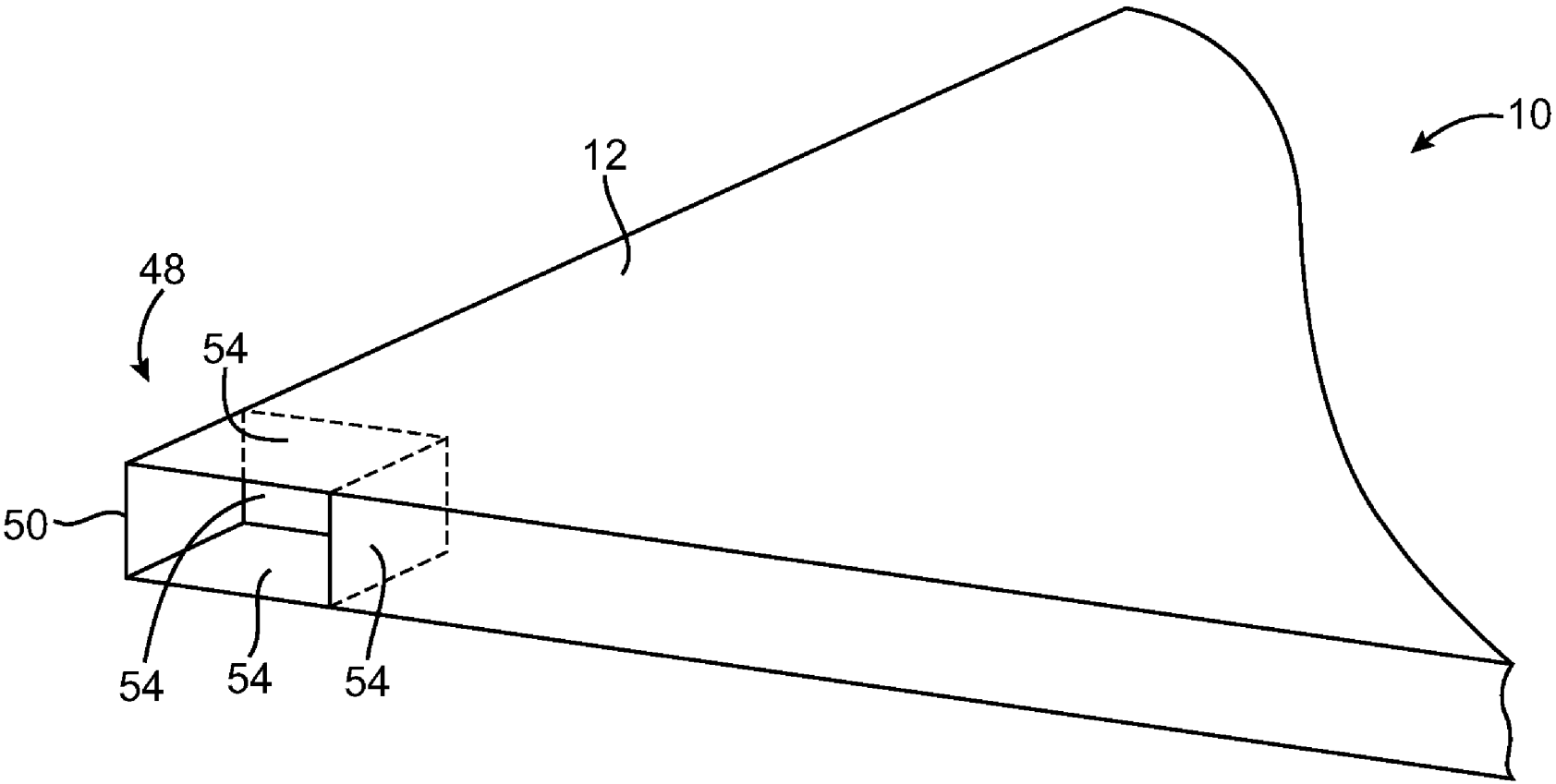
FIG. 6 is a perspective view of a corner portion of an electronic device such as a portable computer that includes a cavity antenna in accordance with an embodiment of the present invention.

FIG. 6 shows a perspective view of an illustrative cavity antenna such as antenna 48 of FIGS. 4A that has been formed at the corner of housing 12 of portable computer 10. Antenna 48 of FIG. 6 may be formed in a corner of a computer housing lid, in a corner of a computer housing base unit, or within other suitable structures in computer 10. Feed 50 may be formed from a metal wire or other suitable probe structure. Positive and ground antenna feed terminals (e.g., terminals associated with a coaxial cable or other transmission line) may be used in feeding probe 50 and antenna 48.

When the wire or other conductive structure that makes up probe 50 is short, probe 50 will tend to have a relatively small real component to its impedance and will tend to have a negative (capacitive) imaginary impedance component. For satisfactory impedance matching between the antenna transmission line and cavity antenna 48, it may be desirable to enhance the impedance of probe 50 (e.g., by adding an inductive characteristic to probe 50 through its construction and/or by adding other impedance matching network components to antenna 48). The addition of an inductive component to the impedance of probe 50 may help to counterbalance the capacitive nature of a short probe structure and may thereby facilitate transmission line impedance matching.

Figure 7:
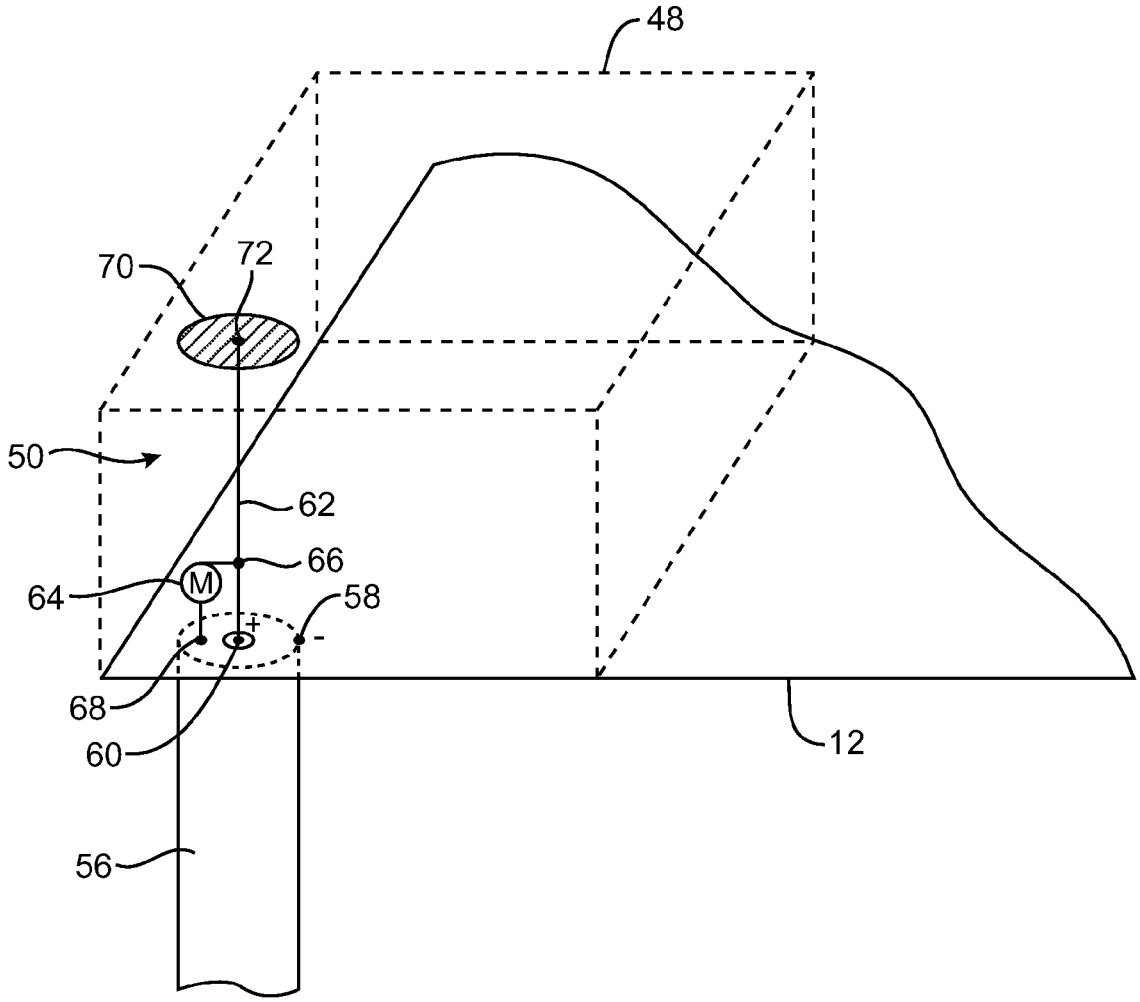
FIG. 7 is a perspective view of a portion of a cavity antenna structure having illustrative feed and impedance matching components in accordance with an embodiment of the present invention.

FIG. 7 shows an illustrative arrangement for probe 50. In the configuration of FIG. 7, probe 50 has conductive member 62 (e.g., a coaxial cable center conductor or other conductor). Tip 72 of conductor 62 is loaded with conductive loading structure 70. Conductive loading structure 70 may be formed from a wire, a planar conductive loading patch, or other conductive structures. The presence of the top-loading provided by loading conductor 70 helps to increase the effective length of conductor 62 without excessively increasing the vertical height of cavity 48 (i.e., the X dimension LX/2 of cavity 48).

As shown schematically in FIG. 7, a matching network such as matching network 64 may be used to help match the impedance of probe 50 and cavity antenna 48 to transmission line 56. Matching network 64 may be based on a segment of a transmission line, or circuit components such as inductors, capacitors, and resistors, and may be connected in a shunt configuration (e.g., across terminals 66 and 68 as shown in FIG. 7), in series with probe conductor 62, or in a configuration in which some of the matching network components are connected in series and some of the matching network components are connected in a shunt configuration. Impedance matching structures for impedance matching network 64 may, if desired, be formed from the structures that make up cavity 48 (e.g., conductive and dielectric structures such as conductor 62, loading structure 70, cavity sidewalls, dielectric loading material, etc.). Impedance matching structures such as these may be combined with impedance matching circuits formed from circuit components such as capacitors, inductors, and resistors, if desired.

As shown in FIG. 7, coaxial cable 56 (or other suitable transmission line) may be coupled to cavity antenna 48 and probe 62 at terminals such as ground antenna feed terminal 58 and positive antenna feed terminal 60. During radio-frequency signal transmission operations, radio-frequency signals that are provided to cavity antenna 48 via transmission line 56 may be transmitted from cavity antenna 48. During radio-frequency signal reception operations, radio-frequency signals may be received by antenna 48 and passed to transmission line 56. Transmission line 56 may be coupled to radio-frequency transceiver circuitry (e.g., circuitry in input-output circuit 32B of FIG. 1). Some or all of the cavity walls for cavity antenna 48 may be formed by portions of conductive case 12.

Figure 8:
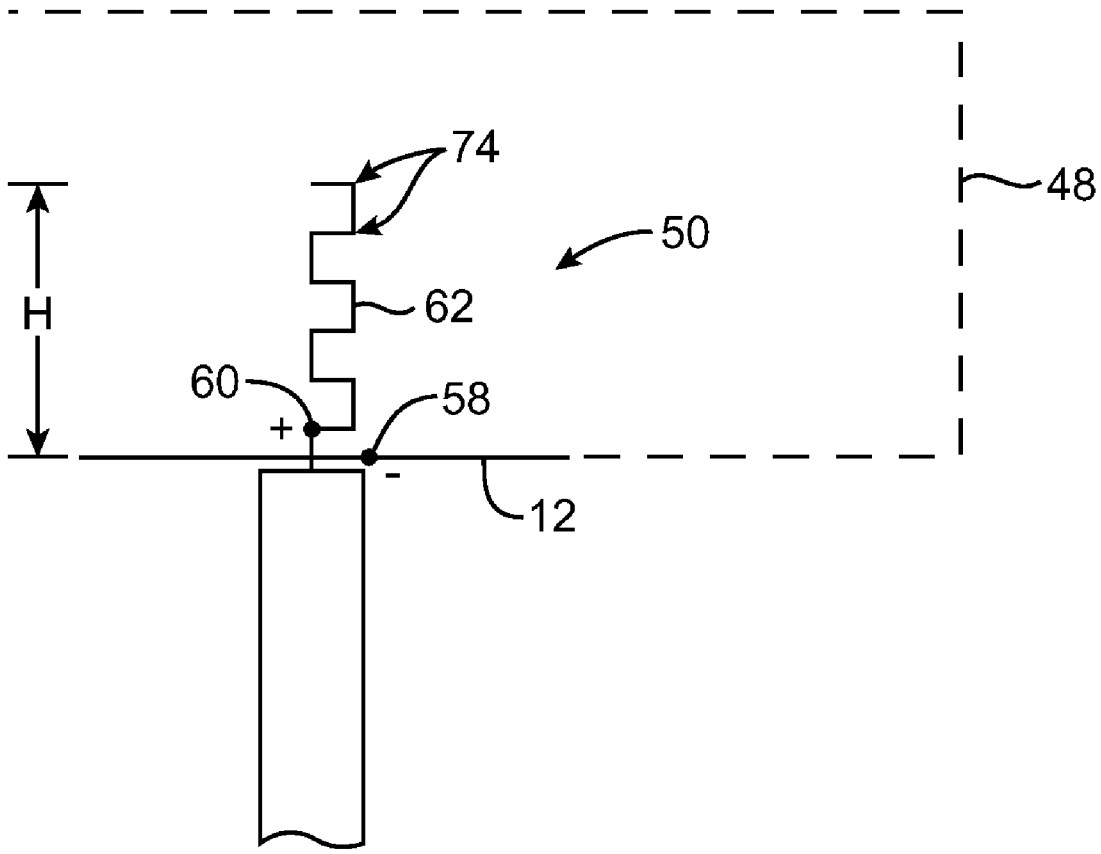
FIG. 8 is a cross-sectional side view of an antenna probe structure based on a meandering conductive element that may be used to feed a quartered rectangular antenna cavity in accordance with an embodiment of the present invention.

If desired, conductive member 62 of probe 50 may be formed from a meandering conductor. As shown in FIG. 8, for example, conductor 62 may have bend such as bends 74. Bends 74 may form right angles (i.e., bends 74 may be perpendicular bends), may form curves in conductive member 62, or may have other shapes that form a meandering path for probe 50. When conductive member 62 of probe 50 has a meandering path shape, the height H of probe 50 will be less for a given overall path length than would otherwise be possible. This allows the vertical dimension LX/2 of cavity 48 to be reduced to fit within the tight confines of a portable computer or other electronic device without excessively reducing the length of probe 50.

Figure 9:
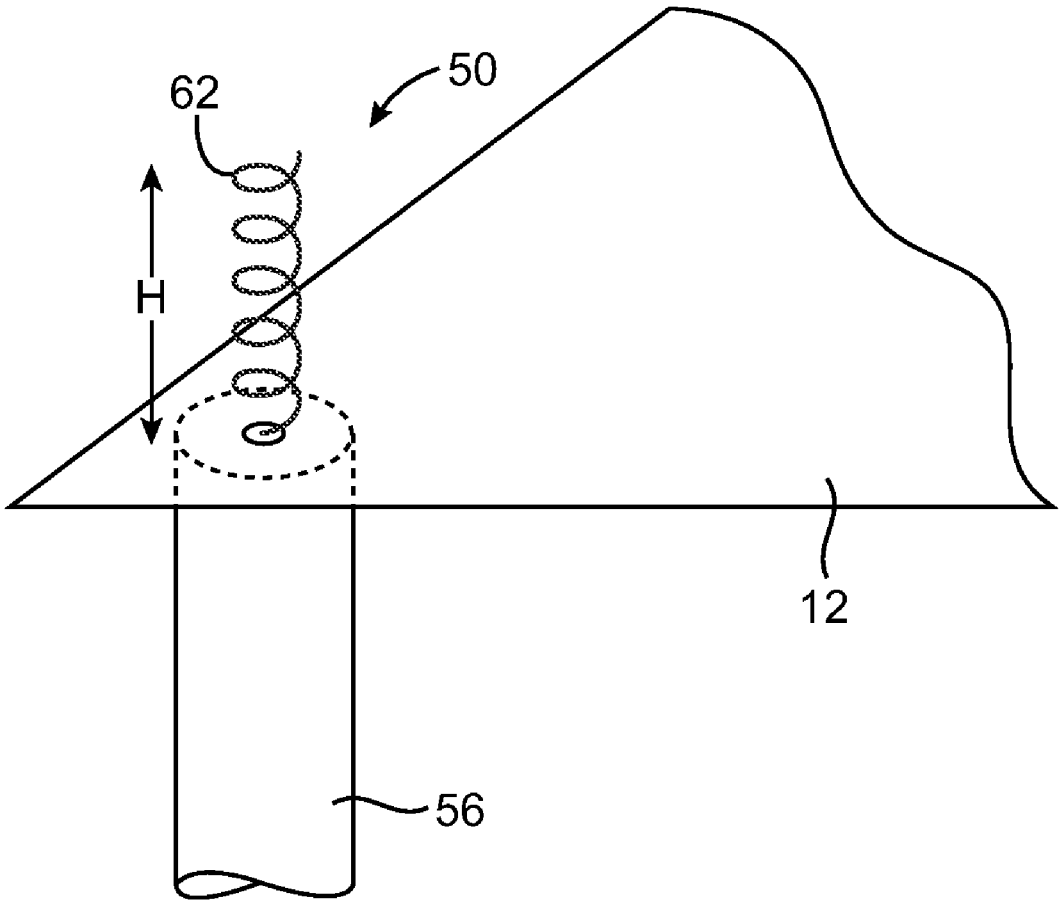
FIG. 9 is a perspective view of an antenna probe structure based on a spiral conductive element that may be used to feed a quartered rectangular antenna cavity in accordance with an embodiment of the present invention.

Some or all of conductive member 62 may be provided with a spiral shape, as shown in FIG. 9. The use of a spiral shape for probe 50 may create inductance to offset the capacitive qualities of a short probe length. The spiral shape of conductive member 62 may also help to reduce the height H of probe 50 within the cavity antenna for a given probe length.

Cavity antenna 48 may exhibit good radiation efficiency and may therefore be suitable for transmitting and receiving radio-frequency signals that pass through a relatively small gap. As a result, it may be desirable to mount cavity antenna 48 within portable computer 10 in a configuration in which the openings of the cavity antenna transmit and receive radio-frequency signals through an opening in housing 12 (as an example).

Figure 10:
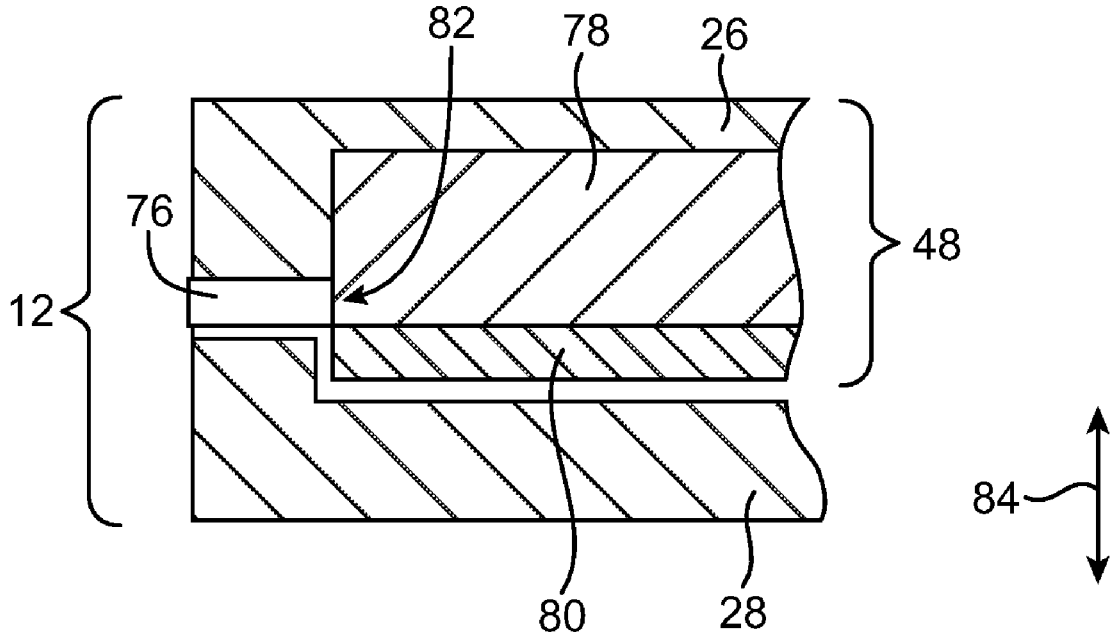
FIG. 10 is a cross-sectional side view of a dielectric-filled cavity-backed antenna structure that operates through a narrowed dielectric gasket window and that is formed as an integral portion of the housing of an electronic device such as a portable computer in accordance with an embodiment of the present invention.

An illustrative arrangement of this type is shown in FIG. 10. As shown in the cross-sectional view of FIG. 10, cavity antenna 48 may be formed in housing 12 of computer 10. Housing 12 may have housing portions such as upper portion 26 and lower portion 28. Gasket 76 may be formed from a dielectric such as a soft elastomeric substance. Gasket 76 may help to cushion housing 12 when upper housing portion 26 (e.g., the computer lid) is closed and bears against lower housing portion 28 (e.g., the computer base).

Dielectric 78 may be used to provide dielectric loading for cavity antenna 48. Dielectric 78 may be formed from any suitable dielectric such as epoxy, polyimide, void-filled solids, etc. Dielectric 78 may fill all or part of the cavity portion of cavity antenna 48. When dielectric 78 is incorporated into the cavity of cavity antenna 48, the dimensions of cavity 48 can be reduced for a given operating frequency, due to the dielectric loading provided by the dielectric.

Layer 80 may be a conductive layer such as a sheet of metal or may be a dielectric such as a sheet of glass or plastic. The dimensions of cavity 48 may be defined by the shape of housing portions 26 and 28 (e.g., where layer 80 is dielectric) or may be defined by the shape of housing portion 26 (on the top) and layer 80 (on the bottom).

Consider, as an example, the situation in which structures 26 and 80 are conductive and are filled with a nongaseous dielectric 78. Cavity antenna 48 may be located at a corner of housing 12 and may be fed using a probe such as probe 50 of FIGS. 7, 8, and 9 or other suitable probe structure that serves as an antenna feed. Gasket 76 may cover openings 52 (e.g., the left and front planar open faces of the cavity of FIG. 3A). During operation, radio-frequency signals may be transmitted and received through gap 82 and the dielectric material of gasket 76. Gasket 76 may be relatively thin (e.g., about 2 mm in dimension 84), so the presence of cavity antenna 48 may easily be concealed from view. This can help provide computer 10 with a pleasing appearance that is not interrupted by the presence of unsightly antenna structures.

The foregoing is merely illustrative of the principles of this invention and various modifications can be made by those skilled in the art without departing from the scope and spirit of the invention.

What is claimed is:

1. A cavity antenna comprising:

top and bottom conductive walls;

first and second conductive side walls, wherein the top and bottom conductive walls and the first and second conductive sidewalls are connected to form a conductive rectangular cavity with first and second side wall openings that meet at a right angle along an axis; and a conductive probe structure at the axis that serves as a feed for the cavity antenna.

2. The cavity antenna defined in claim 1 wherein the top conductive wall comprises a portion of a conductive computer housing.

3. The cavity antenna defined in claim 1 wherein the top and bottom conductive walls comprise portions of a conductive portable computer housing.

4. The cavity antenna defined in claim 1 wherein the conductive probe structure comprises a wire that runs parallel to the axis.

5. The cavity antenna defined in claim 4 wherein the conductive probe structure comprises:

a wire having a tip; and a planar conductive patch connected to the tip.

6. The cavity antenna defined in claim 5 wherein the planar conductive patch comprises a conductive disk.

7. The cavity antenna defined in claim 1 wherein the conductive probe structure comprises a conductive spiral member.

8. The cavity antenna defined in claim 1 wherein the conductive probe structure comprises a conductive member with bends that form a meandering path.

9. An electronic device, comprising:

a conductive housing having corners; and a cavity antenna located at one of the corners, wherein the cavity antenna comprises a rectangular cavity having top and bottom conductive walls and first and second conductive side walls, and wherein the rectangular cavity has first and second open faces that are respectively parallel to the first and second conductive side walls.

10. The electronic device defined in claim 9 wherein the electronic device is a portable computer and wherein the conductive housing comprises a metal portable computer housing.

11. The electronic device defined in claim 9 further comprising an antenna feed formed from a conductive member that extends substantially between the top and bottom conductive walls without electrically connecting to the top and bottom conductive walls.

12. The electronic device defined in claim 11 wherein the conductive member comprises a conductor with a tip and a planar loading patch connected to the tip.

13. The electronic device defined in claim 11 further comprising a radio-frequency transmission line coupled to the cavity antenna at first and second antenna feed terminals that are associated with the antenna feed, wherein the first antenna feed terminal is connected to the conductive member and the second antenna feed terminal is connected to the bottom conductive wall.

14. The electronic device defined in claim 11 further comprising a coaxial cable having a center conductor connected to the conductive member.

15. The electronic device defined in claim 11 further comprising an elastomeric gasket adjacent to the first and second open faces of the rectangular cavity.

16. A portable computer, comprising:

a housing; and a cavity antenna formed at a corner of the housing, wherein the cavity antenna comprises an antenna probe that serves as a feed for the cavity antenna and comprises a cavity with conductive cavity walls and wherein the conductive cavity walls comprise first and second planar conductive side walls and top and bottom conductive walls and define two open faces that allow radio-frequency signals associated with the cavity antenna to enter and exit the cavity.

17. The portable computer defined in claim 16 wherein at least some of the conductive cavity walls are formed from portions of the housing.

18. The portable computer defined in claim 16 wherein the antenna probe comprises:

a conductive member having a first end that is coupled to a transmission line conductor and having a second end; and a planar conductive patch that is connected to the second end within the cavity.

* * * * *

UNITED STATES PATENT AND TRADEMARK OFFICE

CERTIFICATE OF CORRECTION

PATENT NO. : 8,125,394 B2
APPLICATION NO. : 12/356496
DATED : February 28, 2012
INVENTOR(S) : Bing Chiang It is certified that error appears in the above-identified patent and that said Letters Patent is hereby corrected as shown below:

On Title Page 2, item [56] column 1, delete "6,680,712 B2 1/2004 Ogawa et al .....343/789" and insert -- 6,680,712 B2 1/2004 Yamamoto et al .....343/789 --

Signed and Sealed this
Sixteenth Day of July, 2013

Teresa Stanek Rea
*Acting Director of the United States Patent and Trademark Office*